US005312074A

United States Patent [19]

Keith et al.

[11] Patent Number: 5,312,074

[45] Date of Patent: May 17, 1994

[54] SAFETY MECHANISM FOR TRACK SYSTEM

[75] Inventors: Glen R. Keith, Gray; Steven J. Hrivnak, Kingsport, both of Tenn.

[73] Assignee: Eastman Chemical Company, Kingsport, Tenn.

[21] Appl. No.: 7,693

[22] Filed: Jan. 22, 1993

[51] Int. Cl.[5] ..... E01B 7/20

[52] U.S. Cl. ..... 246/430; 104/129; 104/130

[58] Field of Search ..... 104/102, 127, 128, 129, 104/130, 131; 246/419, 430, 448, 170, 133, 134

[56] References Cited

U.S. PATENT DOCUMENTS

| | | | |
|---|---|---|---|
| 4,094,252 | 6/1978 | Pater et al. | 104/130 |
| 4,706,782 | 11/1987 | Spoeler et al. | 104/127 X |
| 4,846,073 | 7/1989 | Boyer et al. | 104/130 X |
| 5,012,918 | 5/1991 | Acker et al. | 104/127 X |
| 5,016,541 | 5/1991 | Feaster, Jr. | 104/129 |

*Primary Examiner*—Frank E. Werner
*Assistant Examiner*—Scott L. Lowe
*Attorney, Agent, or Firm*—John F. Stevens

[57] ABSTRACT

This apparatus relates to a safety mechanism for a rail system having tracks adapted to be moved in an out of alignment for the transfer of an object from one track to the other. More specifically, the apparatus relates to a mechanism which prevents the accidental movement of an object off the end of one track unless the tracks are in substantial alignment.

2 Claims, 5 Drawing Sheets

SAFETY MECHANISM FOR TRACK SYSTEM

TECHNICAL FIELD

This invention relates to a rail system having tracks adapted to be moved in and out of alignment for the transfer of an object from one track to the other. More specifically, the present invention relates to a mechanism which prevents the accidental movement of an object off the end of one track unless the tracks are in substantial alignment.

BACKGROUND OF THE INVENTION

In rail systems of the present invention, bins suspended from one track are electrically driven onto another track, and vice versa as needed. A bridge crane transfers bins from tracks at charging stations to tracks at unloading stations and returned, empty, alternately to charging stations. The tracks at the charging and unloading stations are known as "spur tracks." When the track carried by the bridge crane and the spur tracks are not aligned, the bin could be inadvertently driven off the end of the track onto the floor. Regulations require that a stop be engaged to block the bin from passing the end of an open track.

DESCRIPTION OF THE INVENTION

Figure 2:
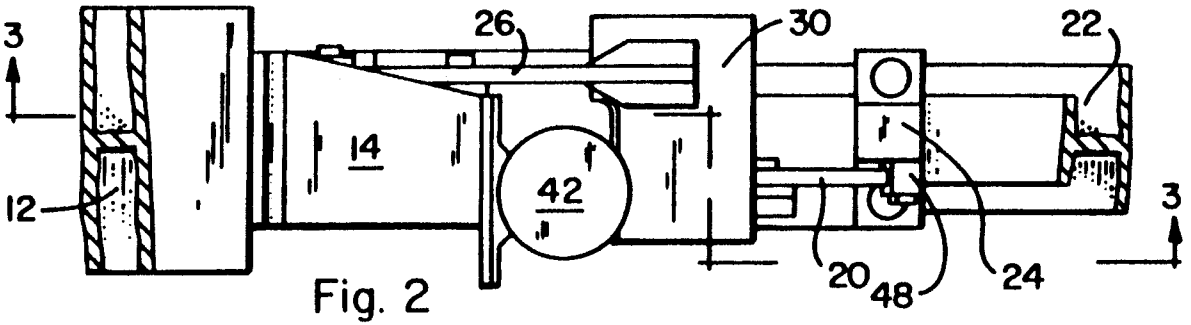
FIG. 2 is a plan view of the mechanism shown in FIG. 1.

In accordance with the present invention, there is provided an improvement in a rail system having first and second tracks, one of which is adapted to be moved in and out of cooperative alignment with the other, wherein the improvement is means for moving pins into functional position only when said tracks are in substantial alignment comprising a) an actuating lever pivotally mounted on said first track, b) means for moving said actuating lever from a first position to a second position, c) a first follower lever pivotally mounted on said second track having a surface for engaging said actuating lever as it is moved from said first position to said second position only when said tracks are aligned, thereby moving said first follower lever from a first position to a second position, d) a second follower lever pivotally mounted on said first track positioned to be rotated by movement of said first follower lever to thereby move from a first position to a second position, e) said first follower lever having a pin connected thereto adapted to cooperate with said second tract and said second follower lever having a pin connected thereto adapted to cooperate with said first track, f) whereby when said actuating lever is moved from said first to said second position, both said first follower lever and said second follower lever are moved from their respective first positions to their respective second positions to move said pins into cooperating positions with said tracks.

More specifically, there is provided an improvement in a rail system having a crane track and spur tracks adapted to be moved in and out of cooperative alignment, wherein the improvement is means for moving pins into position to stop movement of an object moving on said track only when said tracks are in substantial alignment comprising a) an actuating lever pivotally mounted on said main track, b) means for moving said actuating lever from a first position to a second position, c) a first follower lever pivotally mounted on said spur track having a surface for engaging said actuating arm as it is moved from said first position to said second position only when said tracks are aligned, thereby moving said first follower lever from a first position to a second position, d) a second follower lever pivotally mounted on said main track positioned to be rotated by movement of said first follower arm to thereby move from a first position to a second position, e) said first follower lever having a pin connected thereto adapted to cooperate with said spur tract and said second follower lever having a pin connected thereto adapted to cooperate with said crane track, f) whereby when said actuating lever is moved from said first to said second position, both said first follower lever and said second follower lever are moved from their respective first positions to their respective second positions to move said pins into cooperating positions with said tracks.

As used herein, the term "track" is often used to refer to a structure having a cross section similar to an I-beam. The track is typically a monorail.

The present invention has particular application to a monorail system of a crane track and at least one spur track, wherein the crane and spur tracks are brought into substantial alignment for the transfer of a bin, container or hopper (referred to often herein as "bin") from the crane track to a spur track and vice versa. Therefore, the invention will be described with particular reference to such a system.

Although it is convenient to move the bins along the track using an overhead crane by means well known in the art, the bins may be moved by other means, such as self power, or even by hand. The track which is movable between spur tracks will be referred to herein as the "crane" track.

In our invention, bins are suspended from crane main and spur tracks, and are moved by conventional means, such as electrical bridge cranes, along the crane track until they reach a selected spur track. At this point, the bin transfers from the crane track to the spur track where it is stored. Usually, a bin is loaded or unloaded on the spur track, and is transferred back onto the crane track for moving to a selected location. It is at the point of transfer from the crane to the spur, or from the spur to the crane track that the present invention is useful. If the tracks are not in substantial alignment, there exists the possibility of the bin moving off of its track and falling, endangering personnel and causing property damage. Thus, the present invention provides for the placement of safety stops or latches on the track unless the tracks are in substantial alignment. When the tracks are aligned, however, the stops are retracted for passage of the bin. The basic operation of the present invention includes a linkage operated by a solenoid with a retractable stop pin on the crane track and an cooperating linkage and retractable stop pin on the spur track.

The bins are preferably moved by an electrically powered bridge crane along the tracks. When the bridge crane and spur track are aligned, the solenoid powered linkage on the bridge crane lifts the stop pin on the spur track and the induced motion on the spur track stop pin lifts the stop pin on the main track. When the stops are not aligned, energizing the solenoid will not lift either stop pin.

Referring to the drawings, the linkage or lever system according to this invention includes an actuating or driving lever 10 pivotally mounted on a first or crane track 12 by means of frame 14 through swing link 16 which pivots at point 18, a first follower or driven lever 20 pivotally mounted on second or spur track 22 by means of frame 24, and a second follower or driven lever 26 pivotally mounted on main track 12 through frame 14. Lever 10 has a surface 28 for contacting pad 30 fixed to lever 20. Pad 30 is also adapted to mate with contact surface 32 of lever 26 when the rails 12 and 22 are aligned.

Levers 20 and 26 have pivotally attached to each, at 56 and 36, a stop pin 38 and 40 respectively. Stop pins 38 and 40 operate in a reciprocating manner when solenoid 42 is actuated. When solenoid 42 is energized, lever 10 rotates about its pivot 44 through swing link 16 mounted at 18 on frame 14 contacting follower lever 20 to rotate it about its pivot 46 through swing link 48 which in turn is pivotally mounted at 50 on frame 24. As lever 20 rotates, it retracts stop pin 40 in linear motions. Simultaneously as follower lever 20 is rotated, it contacts lever 26 at 32 to rotate it about its pivot 34 on swing link 36 which is pivotally attached to frame 14 at 52. Likewise, follower lever 26 is pivotally attached at 56 to stop pin 38 and when rotated, retracts stop pin 38 in linear movement.

It will be apparent that unless tracks 12 and 22 are in substantial alignment, the contacting surface 28 of lever 10 and pad 30 on lever 20 will not mate, and the contacting pad 30 of lever 20 and surface 32 of lever 26 will not mate, thus providing no movement of levers 20 and 26 even if solenoid 42 is energized.

Swing links 36 and 48 are provided to allow the proper motion to levers 20 and 26 to deliver linear motion to stop pins 38 and 40 respectively when such levers are rotated.

Lever 20 is preferably provided with a wide contacting pad 30 for receiving rotating motion from lever 10 and inducing rotating motion to lever 26.

Figure 1:
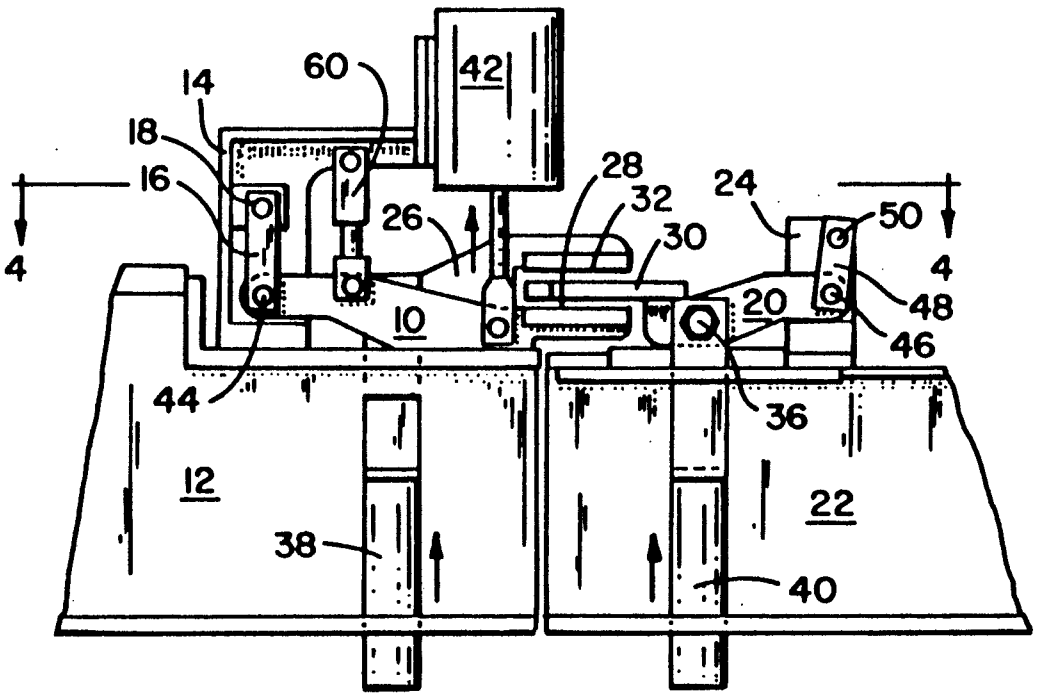
FIG. 1 is an elevation view of the rail safety mechanism according to this invention.
Figure 4:
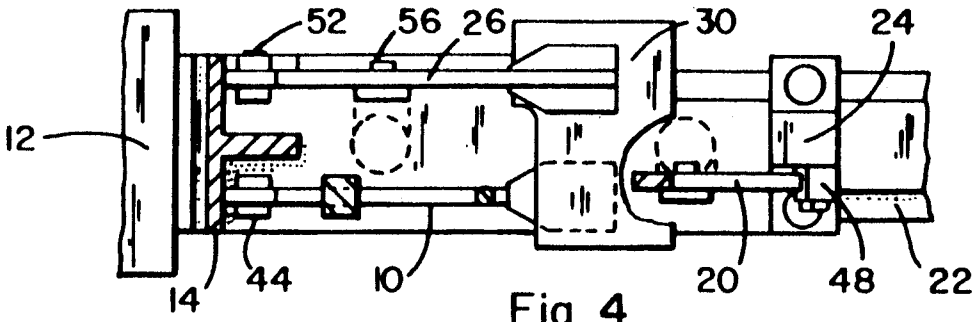
FIG. 4 is a section view taken along line 4-4 of FIG. 1.
Figure 3:
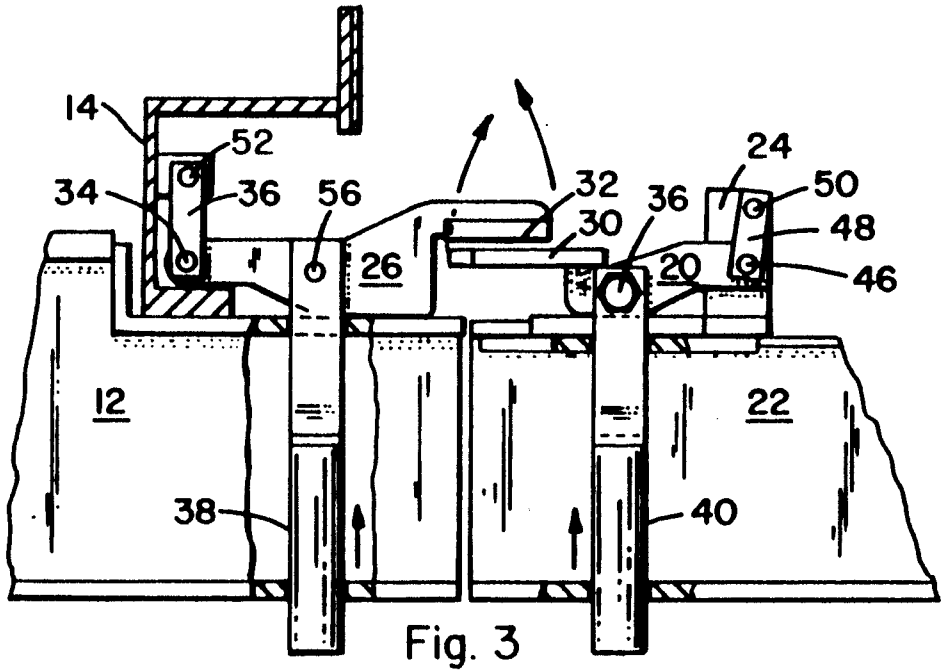
FIG. 3 is a section view taken along line 3-3 of FIG. 2.
Figure 5:
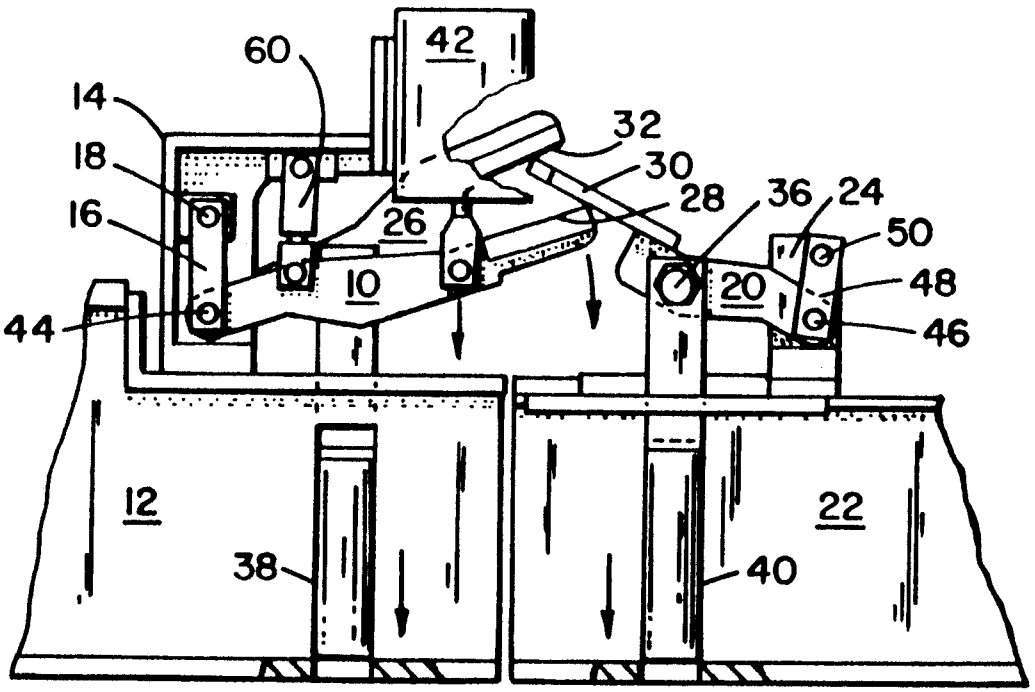
FIG. 5 is an elevation view, partially cut away, showing operation of the safety mechanism, i.e., moving into activated position when the track are in alignment.
Figure 6:
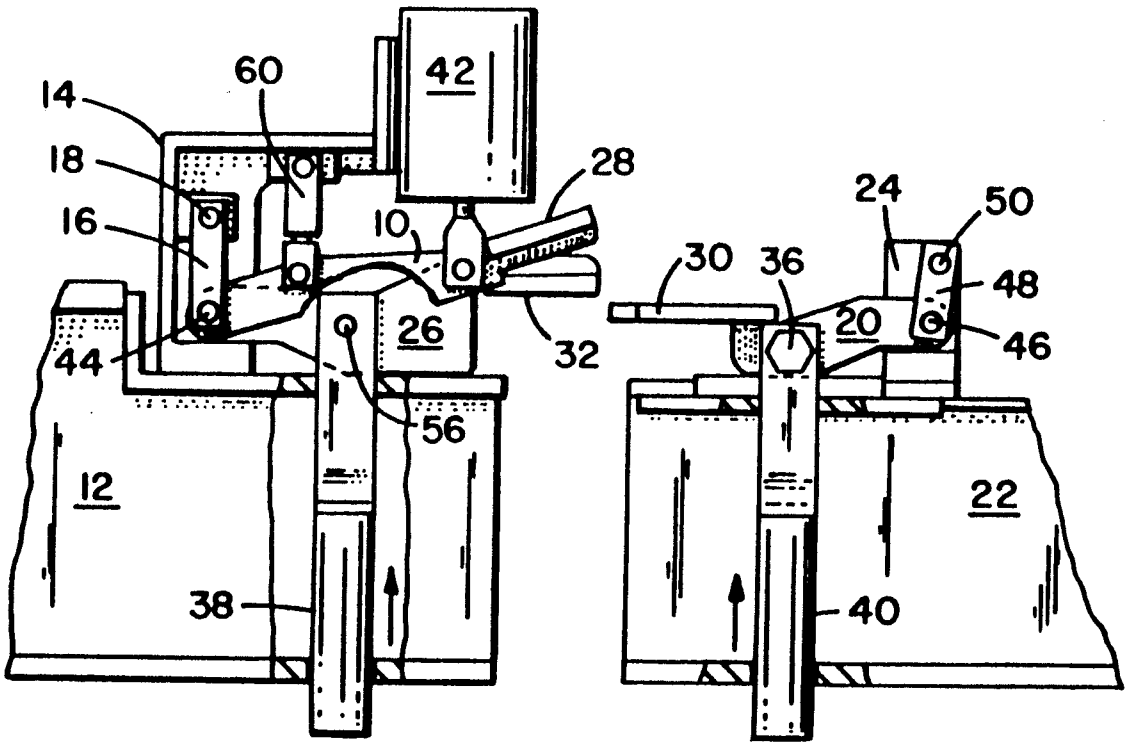
FIG. 6 is a view similar to FIG. 5, but showing the tracks in non alignment, so the mechanism does not function to lift the safety stops.

Spring loaded arm 60 is pivotally attached to frame 14 and lever 10 to return lever 10 in the position shown in FIG. 1 after solenoid 42 is de-energized.

Figure 7:
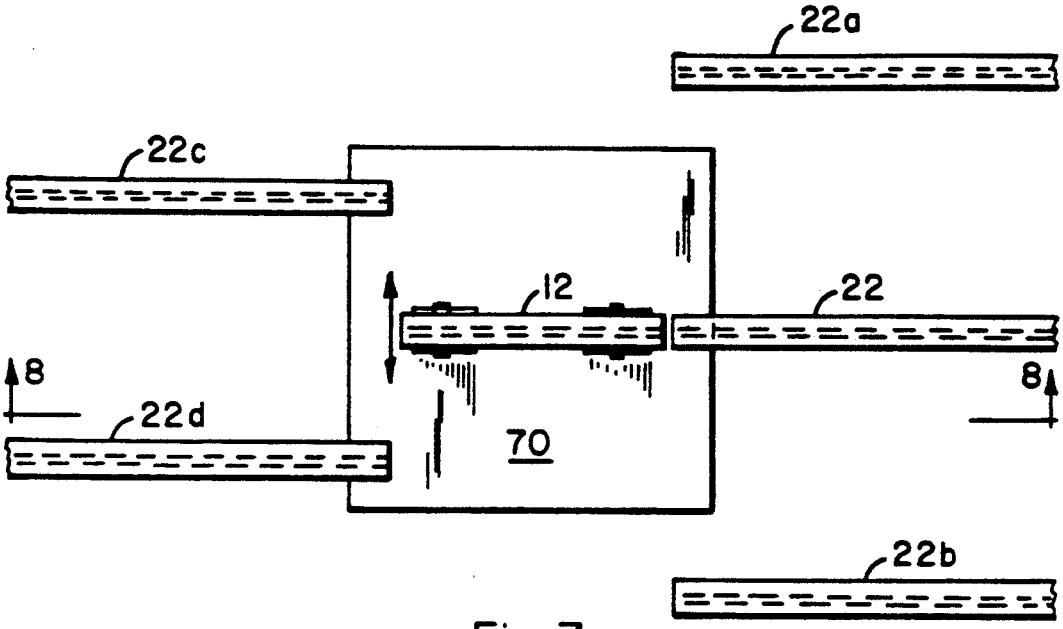
FIG. 7 is a schematic plan view showing a crane and spur track arrangement for moving objects.
Figure 8:
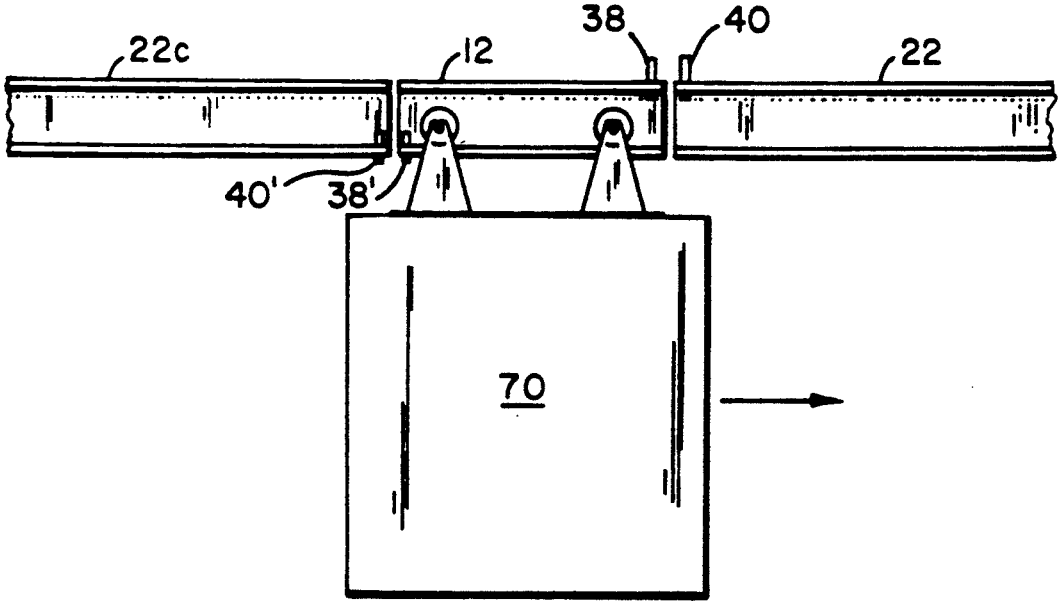
FIG. 8 is an elevation view of the arrangement shown in FIG. 7.

A rail system to which the present invention has application is shown in FIGS. 7 and 8. As illustrated best in FIG. 7, crane track 12 is movable in the direction of the arrows by means such as an overhead crane (not shown). Crane track 12 may be stopped at any of the spur tracks 22, **22*a*, 22*b*, 22*c* and 22*d* and be positioned in alignment with such spur tracks for transfer of an object such as bin 70 from crane track 12 to spur track 22. Once substantial alignment of the tracks has been accomplished, the mechanism according to this invention (shown in FIGS. 1–6), but not in FIGS. 7 and 8) is activated by energizing the solenoid to retract stop pins 38 and 40. With these pins retracted, bin is free to be moved to spur track 22. Bin may be moved on the spur track 22 by any convenient means, such as its own motor. Because crane track is not aligned with any other spur tracks, stop pins on the other side (38' and 40'**) are in place to prevent movement of bins off the crane track on that side.

The invention has been described in detail with particular reference to preferred embodiments thereof, but it will be understood that variations and modifications can be effected within the spirit and scope of the invention.

We claim:

1. In a rail system having first and second tracks, one of which is adapted to be moved in and out of cooperative alignment with the other, the improvement of a device for moving pins from a cooperating position, wherein said pins act to block the passage of a railway vehicle attempting to travel over a portion of track near the pins, to a functional position, wherein said railway vehicle may travel over the portion of track near the pins unobstructed, said functional position occurring only when said first and second tracks are in substantial alignment, the device comprising a) an actuating lever pivotally mounted on said first tract, b) means for moving said actuating lever from a first position to a second position, c) a first follower lever pivotally mounted on said second track having a surface for engaging said actuating lever as it is moved from said first position to said second position only when said tracks are aligned, thereby moving said first follower lever from a first position to a second position, d) a second follower lever pivotally mounted on said first track, positioned to be rotated by movement of said first follower lever to thereby move from a first position to a second position, e) said first follower lever having a first pin connected thereto adapted to be in said cooperating position with said second track and said second follower lever having a second pin connected thereto adapted to be in said cooperating position with said first track, f) whereby when said actuating lever is moved from said first to said second position and said first track is aligned with said second track, both said first follower lever and said second follower lever are moved from their respective first positions to their respective second positions to move said first pin and said second pin into said functional positions with said second track and said first track respectively.

2. In a rail system having main and spur tracks adapted to be moved in and out of cooperative alignment, the improvement of means for moving pins into a cooperating position to stop movement of an object moving on said track except when said tracks are in substantial alignment comprising a) an actuating lever pivotally mounted on said main track, b) means for moving said actuating lever from a first position to a second position, c) a first follower lever pivotally mounted on said spur track having a surface for engaging said actuating lever as it is moved from said first position to said second position only when said tracks are aligned, thereby moving said first follower lever from a first position to a second position, d) a second follower lever pivotally mounted on said main track positioned to be rotated by movement of said first follower lever to thereby move from a first position to a second position, e) said first follower lever having a first pin connected thereto adapted to be in said cooperating position with said spur track and said second follower lever having a second pin connected thereto adapted to be in said cooperating position with said main track, f) whereby when said actuating lever is moved from said first to said second position and said main track is aligned with said spur track, both said first follower lever and said second follower lever are moved from their respective first positions to their respective second positions to move said first pin and said second pin out of the cooperating positions with said spur track and main track, respectively.

* * * * *